US006855041B2

(12) United States Patent
Bocka et al.

(10) Patent No.: US 6,855,041 B2
(45) Date of Patent: Feb. 15, 2005

(54) SANDING MACHINE TOOL

(75) Inventors: Sabine Bocka, Leinfelden-Echterdingen (DE); Marco Balmeli, Solothurn (CH)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 10/398,466

(22) PCT Filed: Jun. 8, 2002

(86) PCT No.: PCT/DE02/02101

§ 371 (c)(1),
(2), (4) Date: Apr. 3, 2003

(87) PCT Pub. No.: WO03/015985

PCT Pub. Date: Feb. 27, 2003

(65) Prior Publication Data

US 2004/0002295 A1 Jan. 1, 2004

(30) Foreign Application Priority Data

Aug. 10, 2001 (DE) ..... 101 39 548

(51) Int. Cl.[7] ..... B24B 23/00

(52) U.S. Cl. ..... 451/357; 451/344; 451/354; 451/514; 51/382

(58) Field of Search ..... 451/344, 354, 451/356, 499, 502, 514, 517, 519, 520, 523, 524; 51/382–387, 170 R, 170 TL, 170 MT, 358

(56) References Cited

U.S. PATENT DOCUMENTS 3,349,523 A * 10/1967 Hutchins ..... 451/518
3,540,161 A * 11/1970 Daughetee et al. ..... 451/344
3,571,986 A * 3/1971 Champayne ..... 451/344
3,822,518 A * 7/1974 Sjostrand ..... 451/516
4,075,793 A * 2/1978 Vogel et al. ..... 451/356
4,077,165 A * 3/1978 Hutchins ..... 451/518
4,475,317 A * 10/1984 Dicke ..... 451/356
5,616,072 A * 4/1997 Walz et al. ..... 451/356
5,902,176 A * 5/1999 Chen ..... 451/524
6,447,382 B1 * 9/2002 Potempka ..... 451/332
6,626,746 B2 * 9/2003 Mayr et al. ..... 451/356

FOREIGN PATENT DOCUMENTS

GB 2 322 582 A 9/1998

* cited by examiner

*Primary Examiner*—Lee D. Wilson
*Assistant Examiner*—Anthony Ojini
(74) *Attorney, Agent, or Firm*—Michael J. Striker

(57) ABSTRACT

An oscillating grinder (10) with a housing (12) a grinding sheet holder (14) having clamping means (20, 23; 200, 230; 334) for receiving a grinding sheet (16), whose grinding sheet ends (17, 19) can be clamped firmly to the grinding sheet holder (14), and in which the clamping means (20, 23; 200, 230; 334, 1334) are levers with a pivot axis (24; 224; 40; 440; 1440) supported on the grinding sheet holder side and clamping jaws (22; 220; 1222; 336, 338) that clamp the grinding sheet (16) on one end, preferably manually actuatable on the other end, can be equipped faster, more conveniently and more securely with a grinding sheet (16) by providing that one of the grinding sheet ends (19) for one-handed operation can be clamped solely by insertion between first clamping means (20, 23; 200, 230; 334; 1334), and the other grinding sheet end (17), likewise for one-handed operation, can be clamped after being placed in second clamping means (34; 334; 1334) and after their actuation; the grinding sheet (16) can be tensed tautly by its subsequent motion, together with the clamped grinding sheet end (17), in particular pivoting, away from the first clamping means (20, 23; 200, 230; 334; 1334).

6 Claims, 6 Drawing Sheets

SANDING MACHINE TOOL

PRIOR ART

Figure 1:
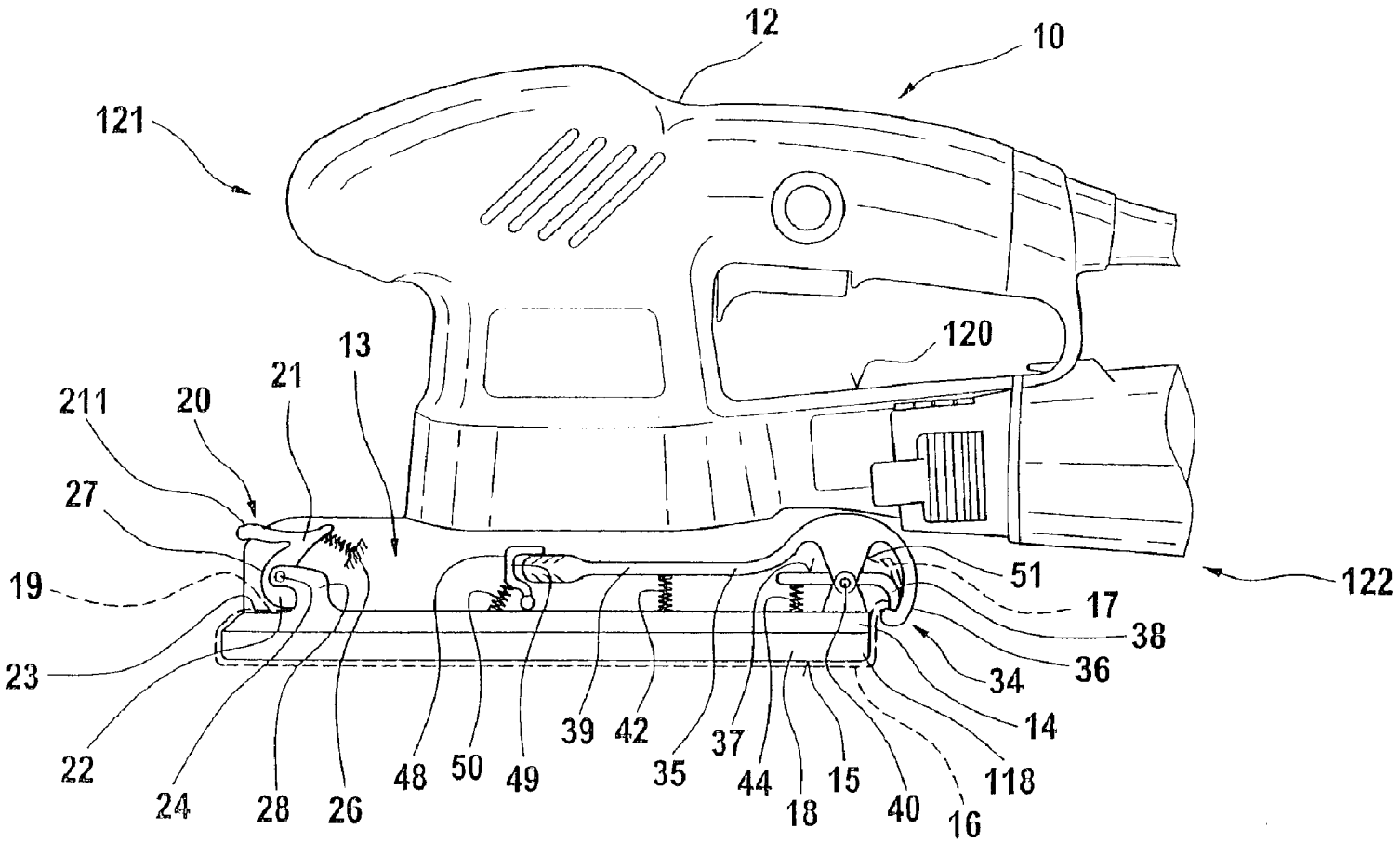

The invention relates to a power grinder as generically defined by the preamble to claim 1.

From British Patent GB 23 22 582, a pivotable pincer with a grinding plate for holding grinding sheets is known; the grinding sheets are braced with their back against the underside of the grinding plate and can be firmly clamped to its top.

The underside of the grinding sheets, which is covered with grinding means, then points downward/outward and when the grinding sheet holder is mounted can be used on a workpiece for grinding.

For firmly clamping the grinding sheets, the user has to use both hands, and if at all possible the power tool should be placed on a firm support. One grinding sheet end has to be introduced with one hand into a slot between an opened clamping jaw and the top side of the grinding sheet holder, while the clamping jaw has to be kept open in the release position with the other hand until the grinding sheet end has been introduced. Once the clamping jaw is let go, it then closes by spring force. This is the clamping position, in which the grinding sheet end is fixed. The grinding sheet is automatically retightened to a certain degree because the rotatably suspended clamping jaw seeks to roll away from the grinding sheet end and carry that end along with it—as a result of a skewed contact-pressure face on the top side of the grinding sheet holder.

The procedure has to be repeated for the other grinding sheet end as for the first, but the clamping force and retightening force of the clamping means are limited.

ADVANTAGES OF THE INVENTION

The power grinder of the invention having the definitive characteristics of claim 1 has the advantage of especially convenient, fast clamping in conjunction with taut tensing of the grinding sheet using only one hand.

This is achieved by providing that the first grinding sheet end can be introduced—with only one hand—into a self-opening slot and clamped automatically there, and then the second grinding sheet end—again with only one hand—can be placed in the clamping-tensing device and is then tensable in taut fashion up to the tearing limit. The grinding sheet can thus be fixed firmly between the two clamping points and on the work face of the grinding holder so that in grinding, the relative motion between the grinding sheet holder and the grinding sheet is minimal. The result is greater abrasion performance and higher overall efficiency of the power grinder.

Because one of the clamping means is designed as a pincer, between which one grinding sheet end can be clamped, and the pincer together with the clamped grinding sheet end is movable about a pivot axis and can be arrested in an end position, convenient and secure clamping with subsequent taut tensing of the grinding sheet can be achieved by simple means.

The pincer has the advantage that grinding sheets of any thickness can be fastened with maximal clamping force, since as a result of a long closing path, all dimensional differences can be sensitively compensated for, and a high clamping force that has previously never been achieved is attainable. Moreover, the power tool can be equipped with grinding sheets that—within limits—are of various lengths, because their protruding ends can be accommodated conveniently in the annularly designed active tensing jaw.

Because spring means seek to keep the passive tensing jaw open, and the active tensing jaw carries the passive tensing jaw along with it, counter to these spring means, into the clamping position and on into the tensing position, and the spring means determine the clamping force on the grinding sheet end, the pincer can be equipped with grinding sheets in a time-saving, convenient and secure way.

Because the active tensing jaw is part of a two-armed tensing lever, whose one lever arm acts as a handle that can be arrested releasably overlockingly in the tensing position, and because for that purpose the pincer can be pivoted about the pivot axis between two end positions that define the tensing and release positions, equipping the tool with a grinding sheet is especially simple.

Because in the tensing position of the pincer the active tensing jaw is braced relative to the passive tensing jaw with a minimum clamping force that can be determined by spring means, the clamping force on the grinding sheet end to be tensed is adjustable by means of a suitable choice of the elastic means.

Because the surfaces of the active and passive tensing jaws have a high coefficient of friction with high stability against deformation, since they are of metal, an especially secure clamping action at the ends of the sandpaper is assured.

Because the active tensing jaw is curved on the order of a round hook and grips the passive tensing jaw in such a way that it is braced against the outside of the passive tensing jaw in order to clamp the grinding sheet and carries the passive tensing jaw along with it upon pivoting into the tensing position, a clamping-tensing mechanism that is easy to use and entails considerably reduced risk of injury upon changing grinding sheets or in working with the power grinder is created, because protruding edges have been avoided.

Because elastic means keep the pincer open in the release position and in particular spread the active tensing jaw apart relative to the passive tensing jaw, it is possible to change the grinding sheet virtually blind.

Because the passive tensing jaw has a continuous longitudinal notch, the grip between the passive tensing jaw and the end of the sandpaper is improved, and the clamping force is reinforced.

Because the clamping means disposed opposite the pincer allow the corresponding grinding sheet end to enter in a preferential direction but do not release it without special actuation in the opposite direction, a firm, play-free clamping of the grinding sheet to the grinding sheet holder is possible using only one hand.

The term one-handed operation means here that for placing and fixing the grinding sheet, in fact only a single hand has to be active. The other hand can rest in the meantime or can fix the power tool, for instance pressing it against a support.

Because of the powerful clamping of the grinding sheet, the play between it and the grinding sheet holder is lastingly minimized. With this provision, the reciprocating grinding motion of the grinding sheet holder is also transferred virtually without slip to the grinding sheet, so that the grinding sheet can effectively engage a workpiece so as to grind it.

Because the clamping jaw has an outer contour whose greatest spacing from the pivot axis is less than the spacing between the pivot axis and the top side of the grinding sheet holder, and because the clamping jaw, toward the edge of the grinding sheet holder, braces itself in elastically rotationally prestressed fashion on one side of the grinding sheet holder, a high clamping force between the clamping jaw and the top side of the grinding sheet holder can be achieved with a simple design of the clamping means, and a servo-clamping effect with increasing tensile force on the sandpaper counter to the insertion direction ensues. As a result, the sandpaper can be clamped firmly practically up to the tearing limit without releasing itself automatically beforehand.

Because the clamping jaw, to release the fastened grinding sheet, is movable counter to the clamping direction by means of a pushbutton, it is especially simple to release the grinding sheet end from the power grinder.

Because the clamping jaw comprises elastic, rubberlike material, the servo effect is reinforced for increasing clamping of the grinding sheet. The servo effect is furthermore reinforced by the provision that the outer contour of the clamping jaw is progressively curved with only slight change in pitch.

Because the clamping tensing of the sandpaper ends is effected via outer end points between the active/passive jaw, and the tensing lever is provided on only one side of the clamping/tensing jaw and can be snapped in place resiliently there, every change of grinding sheet is convenient and secure.

DRAWING

Exemplary embodiments of the invention are described in further detail in the ensuing description in conjunction with associated drawings.

Shown are

Figure 2:
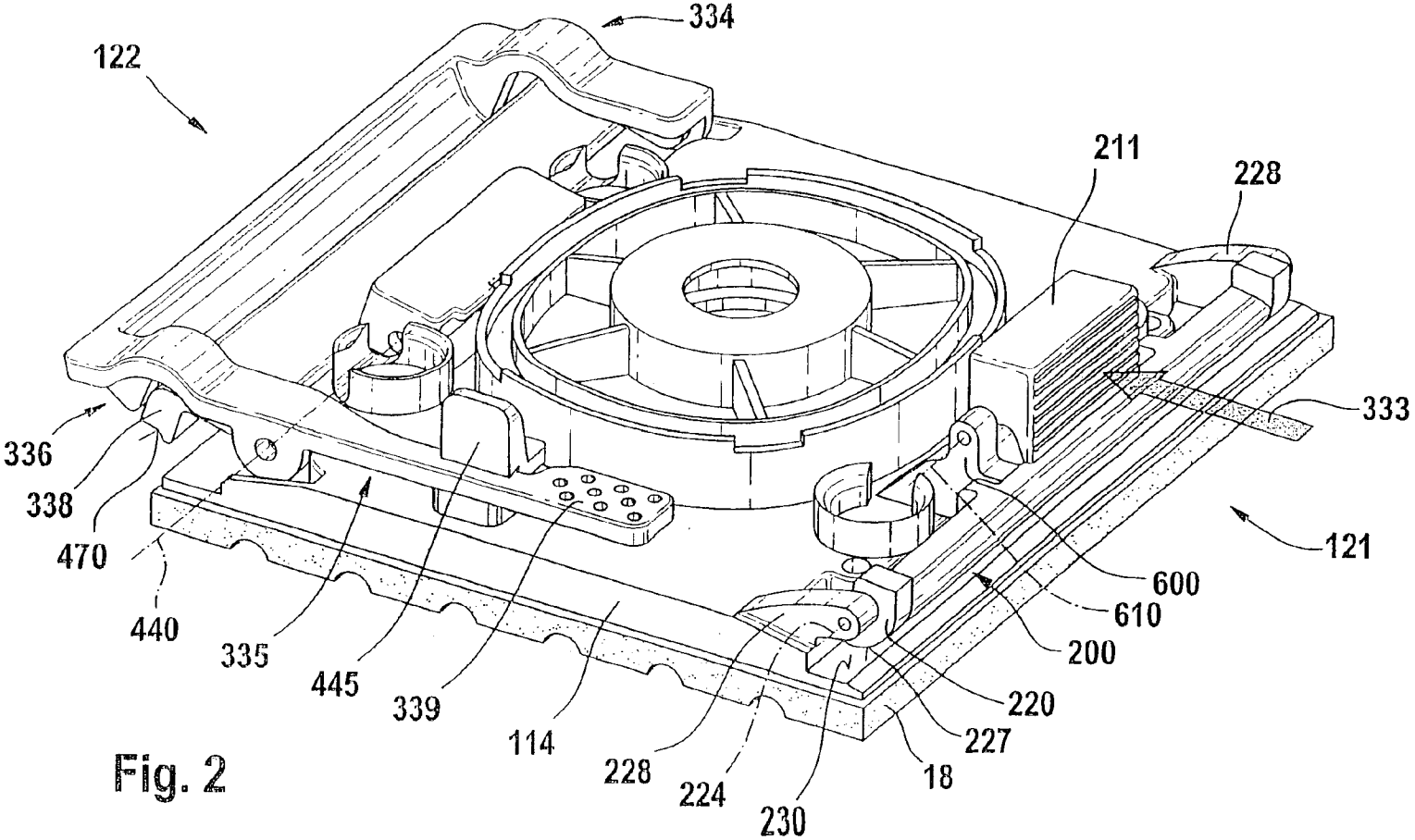
Figure 3:
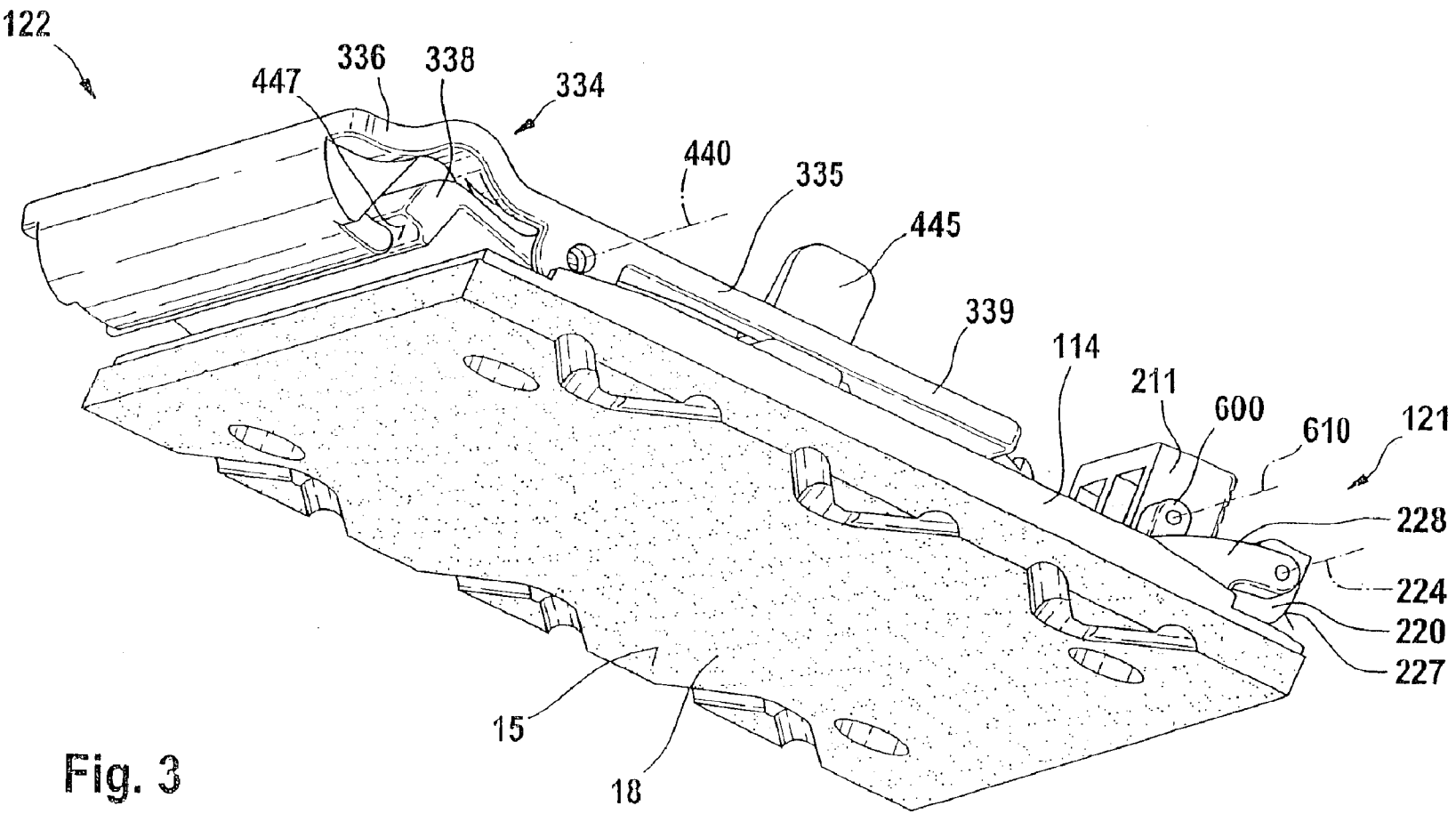
Figure 4:
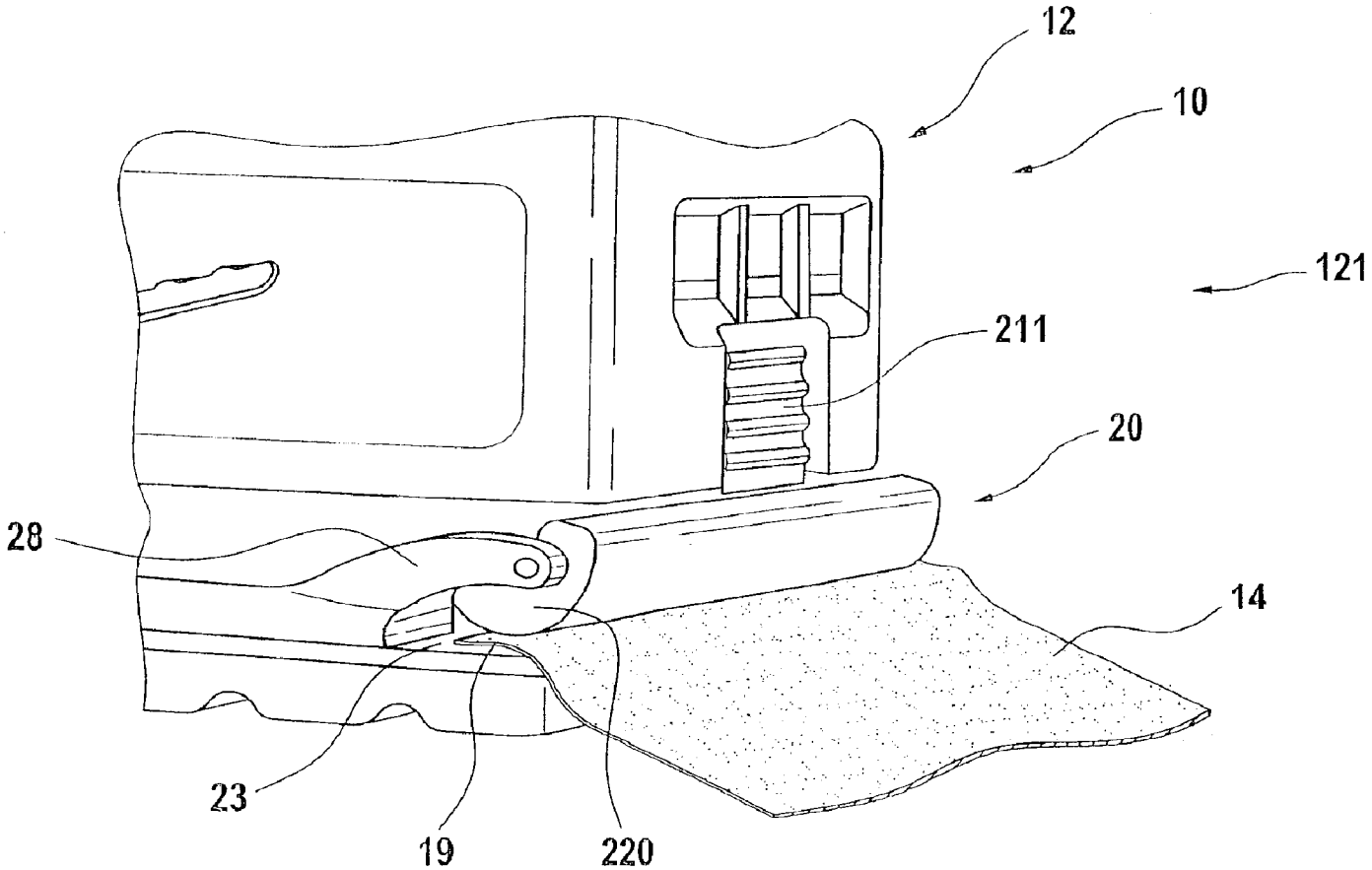
Figure 5:
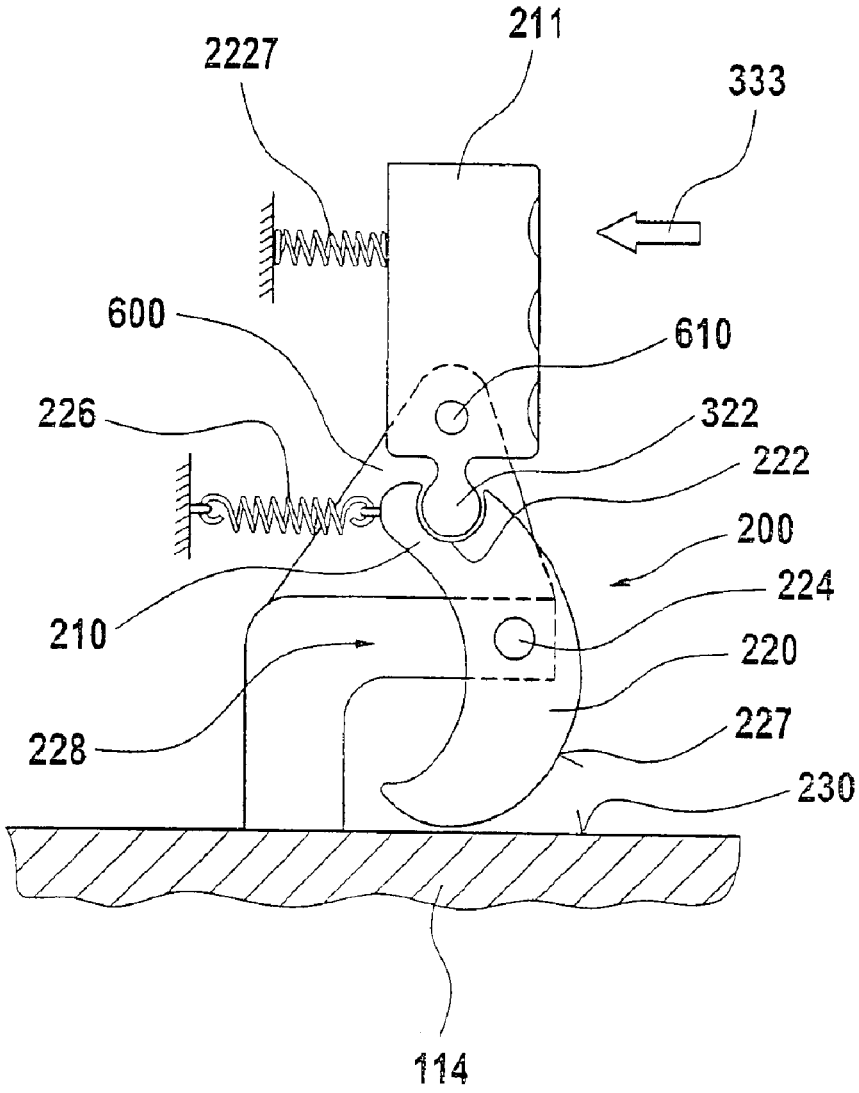
Figure 6:
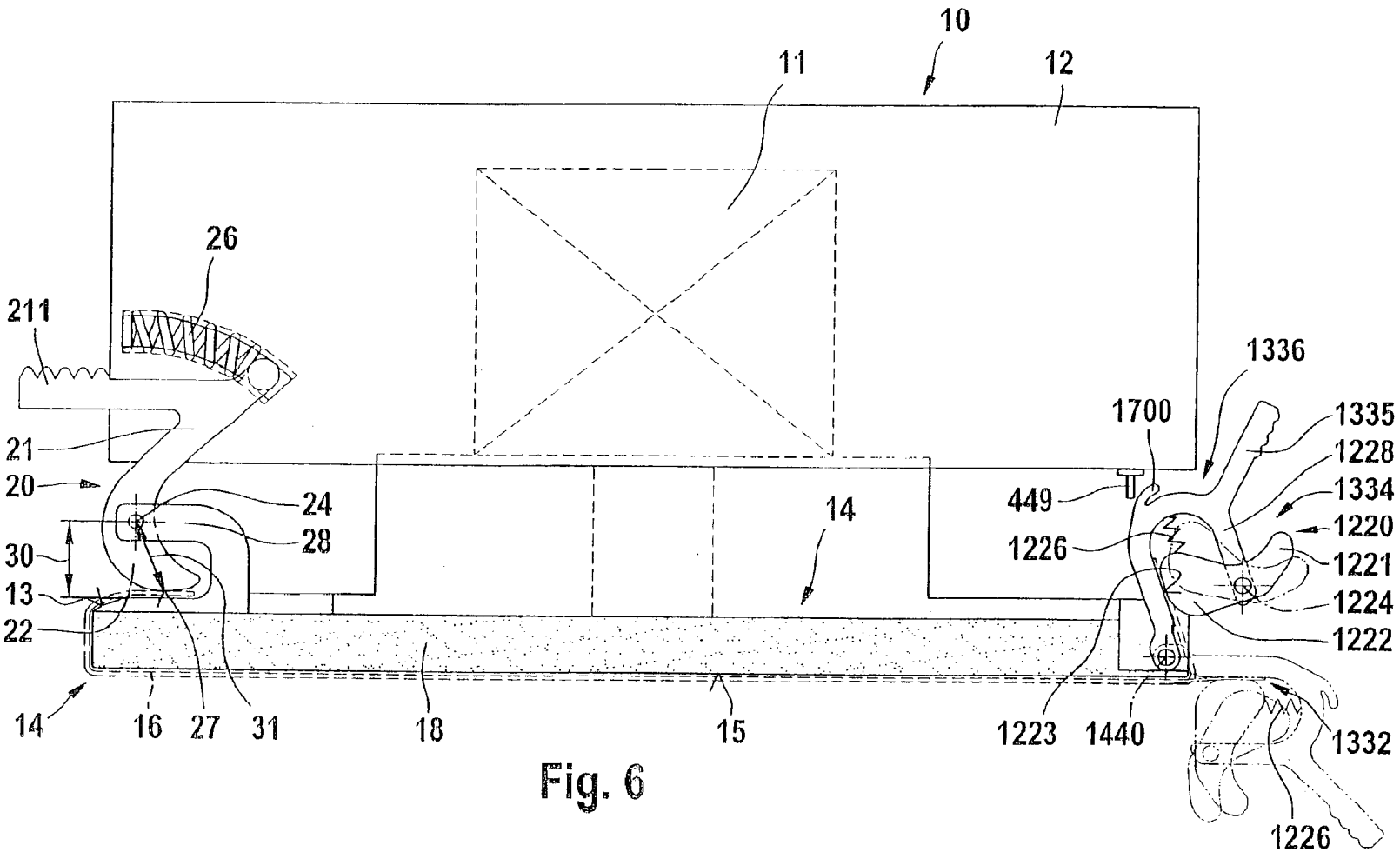

FIG. 1, a side view of the power grinder of the invention;

FIG. 2, a plan obliquely from above on the grinding sheet holder of a further embodiment of the power grinder;

FIG. 3, the bottom view corresponding to FIG. 2;

FIG. 4, a further exemplary embodiment of the power grinder of the invention, obliquely from the front;

FIG. 5, a schematic illustration of the clamping device disposed at the front of the power grinder; and FIG. 6, a schematic side view of a further exemplary embodiment of the power grinder of the invention.

DESCRIPTION OF THE EXEMPLARY EMBODIMENTS

The power grinder 10 in FIG. 1 is a pivotable pincer, with a housing 12 with a handle not identified by reference numeral and with an electric motor disposed in the interior. A grinding sheet holder 14 is seated on the bottom of the housing 12; it can be set into oscillation relative to the housing 12 by being driven by the motor and as a result, with a grinding sheet 16 fixed to the bottom of its working face 15, it can remove material by grinding from a workpiece, not shown. The grinding dust produced can be blown out or extracted by suction from the front side 121 toward the back side 122 of the power grinder 10 through the extraction stub 120.

The grinding sheet 16 is braced with its back side on the grinding sheet holder 14, or its grinding pad 18.

A clamping means, designed as a two-armed clamping lever 20 with a pivot axis 24, is disposed on the front of the top side 13 of the grinding sheet holder 14. The clamping lever 20 forms a swinging arm 21 above the pivot axis 24 and a clamping jaw 22 below it. The clamping jaw is braced with its outer contour 27, curved in a manner of a sable, on the detent face 23 of the top side 13 of the grinding sheet holder 14. The pivot axis 24 of the clamping lever 20 is disposed on a bearing block 28 on the top side of the grinding sheet holder 14.

A tension spring 26 is braced between the top side of the swinging arm 21 and an abutment, not identified by reference numeral, in the housing 12 and seeks to pivot the clamping lever 20 clockwise; it presses the clamping jaw 22 against the detent face 23 and thus firmly clamps the grinding sheet end 19.

In the upper region, the swinging arm 21 has a protruding angle bracket serving as a pushbutton 211. With it, the swinging arm 21 can be moved downward by finger pressure, tensing the tension spring 26. In the process, the clamping jaw 22 lifts from the detent face 23, and the gap between the outer contour 27 and the detent face 23 opens so widely that the grinding sheet end 19 is uncovered and can be removed without taking further steps.

The spacing between the pivot axis 24 of the clamping lever 20 and the detent face 23 is less than the spacing between the pivot axis 24 and the radially outermost point of the outer contour 27, so that in the position prestressed by the spring 26, the tensing jaw 22 is braced against the detent face 23 on the top side 13 of the grinding sheet holder 14. This reinforces the clamping force on the grinding sheet 16 in proportion to the forces that seek to release the grinding sheet 16 counter to the insertion direction.

The tension spring 26 is slightly prestressed, in such a way that the grinding sheet 16, by only slight pressure against the outer contour 27 of the clamping jaw 22, already displaces the clamping jaw from outside counter to the tensing direction and creates the gap required for the insertion on its own and can be easily inserted and subsequently pushed with one hand.

The clamping jaw 22 at least partly comprises elastic, rubberlike material with a high coefficient of friction, which restricts a relative motion between the grinding sheet 16 and the clamping jaw 22.

On the right in the viewing direction, a clamping-tensing device designed as a pincer 34 is disposed on the back side 122 of the grinding sheet holder 14. This clamping-tensing device comprises a tensing lever 35 with a curved active jaw 36 and a handle 39; the handle forms a two-armed lever that is pivotable about a pivot axis 40. Also pivotable about the pivot axis 40 is a clamping lever 37, which forms the passive jaw 38 and is braced on the inner contour of the active jaw 36 in the clamping and tensing of the grinding sheet 16. The sandpaper end 17 opposite the grinding sheet end 19 is put in place and firmly held between the passive jaw 38 and the active jaw 36.

Upon pivoting of the pincer 34 with the firmly held grinding sheet end 17 about the pivot axis 40 counterclockwise, its spacing from the other sandpaper end 19 increases. This makes the grinding sheet 16 taut and presses it firmly against the working face 15 of the pad 18. How pronounced the tautness of the grinding sheet 16 is can be seen particularly from the rear lower edge 118 of the pad 18, which is pressed into roundness.

In the tensing position of the pincer 34, the tensing lever 35 assumes an end position, in which the handle 39 is locked in the detent groove 49 of the rear or lateral detent tab 48. By pushing the detent tab 48 backward with the thumb or by pivoting the handle 39 outward counter to the spring 50 out of the detent groove 49, the tensing lever 35 is set free and can pivot back into its open position with spring prestressing by means of the spring 42. The passive jaw 38—acted upon by a further compression spring 44—follows it into its own end position. The tensing lever 35 pivots onward past this position with spring prestressing, until its stop face 51 rests on the top side 47 of the passive jaw 38. In this stop position, the pincer 34 is opened wide, and the spacing between the active and passive jaws 36, 38 is so great that the sandpaper end 17, represented by dashed lines, can be inserted into the pincer 34 virtually without looking.

The compression spring 44 that prestresses the passive jaw 38 determines or defines the clamping force between the active jaw 36 and the passive jaw 38.

If to change a grinding sheet the tensing lever 35 is released from its tensing position by unlocking the tensing tab 48 and is pivoted clockwise about the axis 40, the spacing between the clamping points of the sandpaper ends 17, 19 becomes shorter again, so that the grinding sheet 16 is untensed and can thus be removed easily.

FIG. 2 shows a three-dimensional view of a further exemplary embodiment of the grinding sheet holder 114 and power tool 10 of FIG. 1 in the form of a plan view obliquely from the front. On the front side 121, on the right in the viewing direction, there is a clamping lever 200, which corresponds essentially to that of FIG. 1 but has a separate actuating key 2110, which is supported pivotably about a pivot axis 610 in an abutment 600 and is braced elastically against the housing, not shown, by a compression spring, also not shown.

When the key 2110 is actuated in the direction of the arrow 333 indicating motion, the part of the key 2110 located above the axis 610 moves toward the housing. The part located below the axis 610 pivots outward and is braced on the upper part of the clamping lever 200. This lever is pivoted outward clockwise upon actuation of the key 2110, so that the clamping jaw 220 lifts from the detent face 230, and a grinding sheet end clamped between them can be removed, since no clamping force is operative any longer.

For comprehension of FIG. 2, reference is made to the parts of FIG. 1 that are the same in terms of function and design. For elements functioning the same in FIG. 2, in a distinction from or agreement with the reference numerals of FIG. 1, its first digit precedes them.

The grinding sheet holder 114, on the left in the viewing direction, has a pincer 334 on its back side 122; this is essentially equivalent to the pincer 34 explained in conjunction with FIG. 1, but it is designed differently in detail. A tensing lever 335 for pivoting the pincer 334 is disposed on only one side of the grinding sheet holder 114 and is supported on that side resiliently lockably on a stop 445.

The pincer 334 is shown in the tensed state, in which its clamping point, or a grinding sheet end not shown, is pivoted to the farthest possible distance from the clamping lever 200 on the opposite side of the grinding sheet holder 114.

FIG. 3 shows the details of the grinding sheet holder 114 of FIG. 2 obliquely from behind and below, making the design of the active jaw 336 in cooperation with the passive jaw 338 clear. In the tensing position shown, these jaws are braced against one another and can hold a grinding sheet end, not shown, clamped between them in a way that is pivoted away from the clamping lever 200, so that an associated grinding sheet can be retained, tensed tautly, in such a way that a relative motion of the grinding sheet with respect to the working face of the grinding sheet holder 114 is minimized. The parts of the clamping lever 200 described above in conjunction with FIGS. 1 and 2 can be seen clearly and need not be explained again here.

FIG. 4 shows the power tool 10 obliquely from the front, with the grinding sheet end 19 placed between the clamping lever 20 and the detent face 23. Here, the shape of the key 211 that is drawn into the contour of the housing 12 in the front region can be seen. As a result of this arrangement, controlled flush grinding is possible with the front side to near a face protruding at an angle from the face to be machined.

FIG. 5 schematically shows a further exemplary embodiment of the clamping lever 20 as a detail in conjunction with the key 211 and the coupling of these two parts. On the front, at the right in the viewing direction, a clamping lever 200 matching that of FIG. 1 is disposed; its axis 224 is disposed on a bearing block 228. The clamping lever 200 has a clamping jaw 220, which can be braced relative to the detent face 230 of the grinding sheet holder 114; a tension spring 226 engaging the outermost end of the swinging arm 210 seeks to pull the clamping jaw 220 toward the detent face 230. In this position, the outer contour 227 of the clamping jaw 220 is braced on the bottom on the detent face 230.

On its outermost end, the swinging arm 210 has a ball-type socket 222, which is engaged by a link pin 322 of the toggle switch 221.

The switch 221 is pivotable by finger pressure in the direction indicated by the arrow 333 about an axis 224 retained on the bearing block 228 and can thus move the clamping lever 200 into its open position for removal of a clamped grinding sheet.

For restoring the switch 221 to its outset position, a compression spring 2227 is disposed between the back side of the switch 221 and the housing 12 of the power grinder 10. This spring acts with additional restoring force on the clamping jaw 220 and seeks to keep it in the "closed" position.

FIG. 6 is a schematic illustration of a further exemplary embodiment of the power tool 10 of the invention; the clamping lever 20 on the left-hand side in the viewing direction matches the corresponding clamping means of FIGS. 1–4, and this arrangement will therefore not be described again in detail.

On the right-hand side in the viewing direction, the grinding sheet holder 14 has a clamping-tensing device 1334 with a clamping lever 1220, which corresponds in structure and mode of operation to the clamping lever 20 on the left-hand side in the viewing direction, and which is movable about a bearing block 1228 about an axis 1224, in the same way as the clamping lever 20. The clamping lever 1220 is pivotable jointly with the bearing block 1228 and the detent face 1223 about an axis 1440. The clamping lever 1220 is prestressed by a compression spring 1226 in such a way that its clamping jaw 1222 seeks to rotate counterclockwise about the axis 1224 and in the process reaches a clamping position for impact against the detent face 1223, in which position each inserted grinding sheet end is held especially firmly.

The clamping lever 1220 is shown in two phases of motion. In its position pivoted to the right and downward in the viewing direction, the grinding sheet end of the grinding sheet 16, which has been clamped beforehand on the left in the viewing direction, must be inserted between the clamping jaw 1222 and the detent face 1223 and then pivoted with the bearing block 1228, by pivoting about its axis 1440, by means of finger pressure on the handle 1339 into the position shown at the top right in the viewing direction, in the course of which the grinding sheet end pivoted with it moves away from the grinding sheet end clamped on the opposite side.

This makes the grinding sheet 16 markedly taut and presses it against the working face 15 of the grinding sheet holder 14. In its end position, the bearing block 1228 is fixed by overlooking of its overlooking cam 1700 via an overlooking spring 449.

The overlooking spring 449 is fixed to the housing. It can be overcome by pivoting the bearing block 1228 backward by exerting appropriate finger pressure on the handle 1339. Once the bearing block 1228 has been pivoted backward about the axis 1440, the grinding sheet 16 relaxes, and the corresponding grinding sheet end can be removed, after the clamping lever 1220 has been pivoted clockwise. The same procedure should be repeated for the other grinding sheet end, by pivoting the clamping lever 20 counterclockwise on the left-hand side, in the viewing direction, of the power tool 10. In this way, the grinding sheet 16 can easily be removed. Equipping the tool with a new grinding sheet is done in reverse order from removing a grinding sheet.

Equipping the power tool 10 of FIG. 1 with a grinding sheet 16 will now be explained. The power tool 10 should be fixed with one hand. With the other hand, the first grinding sheet end 19 should be introduced at the clamping lever 20 by being pressed against the outer contour 27 of the clamping jaw 22. This forms a gap between the clamping jaw 22 and the detent face 23, and this first grinding sheet end enters the gap without requiring separate actuation of the clamping lever 20 as well. Even the tiniest inserted piece of the grinding sheet end is immediately clamped "automatically" with great force and can be released only by pivoting the clamping lever 20 in the release direction.

Passing a hand along the grinding sheet 16 can make the grinding sheet taut and allows the grinding sheet end 19 to be inserted onward between the clamping jaw 22 and the detent face 23 without being able to come back out, and without allowing any letup of the tension on the grinding sheet 16. Thus with relatively little effort, a taut, firm clamping of the grinding sheet 16 to the pad 18 or to the grinding sheet holder 14 is possible. In the clamping-tensing step that follows, the second grinding sheet end 17 should be introduced into the pincer 1334 disposed on the opposite side of the grinding sheet holder 14, and arrested and made taut. The grinding sheet 16 is now taut.

Both ends 17, 19 of the grinding sheet are firmly held by the clamping jaws 22 and the pincer 1334, respectively, at at least two opposed points near the outer corners.

For removal of the grinding sheet 16, the clamping lever 20 should be moved, by pressure on the key 211 as a horizontal extension of the swinging arm 21, jointly with this swinging arm about the pivot axis 24. In the process, the clamping jaw 22, with its outer contour 27, lifts away from the grinding sheet 16 or from the detent face 23 in such a way that the grinding sheet end 17, 19 can easily be pulled out of the increasingly larger gap and thus the grinding sheet 16 can easily be released.

What is claimed is:

1. A power grinder (10), in particular an oscillating grinder, having a housing (12) that holds a motor and having a grinding sheet holder (14) with clamping means (20, 23; 200, 230; 334) for receiving a grinding sheet (16), whose grinding sheet ends (17, 19) can be clamped firmly to the grinding sheet holder (14, 114), and the clamping means (20, 23; 200, 230; 334; 1334) are levers with a pivot axis (24; 224; 40; 440; 1440) supported on the side of the grinding sheet holder and clamping jaws (22; 220; 1222; 336, 338) that clamp the grinding sheet (16) on one end, preferably actuatable manually on the other end, characterized in that one of the grinding sheet ends (19) for one-handed operation can be clamped solely by insertion between first clamping means (20, 23; 200, 230), and the other grinding sheet end (17), likewise for one-handed operation, can be clamped by being placed in second clamping means (34; 334; 1334) and by actuating them, and by subsequent moving of the second clamping means (34; 334; 1334), the grinding sheet (16) together with the clamped grinding sheet end (17) can be tensed tautly away from the first clamping means (20, 23; 200, 230), in particular pivoting.

2. The power grinder of claim 1, characterized in that (FIG. 6), the second clamping means (1334) comprises a clamping jaw (1222) and a detent face (1223), which can be pivoted in common about an axis (1440) in such a way that a grinding sheet end (17) clamped thereto can be moved away from the opposite grinding sheet end (19), so that the grinding sheet (16) can be tensed tautly up to its tearing limit.

3. The power grinder of claim 1, characterized in that the second clamping means is embodied as a pivotable pincer (34; 334; 1334), whose clamping jaw and detent face are formed by an active face (36; 334; 1336) and one passive jaw (38; 338; 1338), and which is closable by moving the active jaw (36; 336; 1336), and the passive jaw (38; 338; 1338), after clamping impact of the active jaw (36; 336; 1336) can be carried along by it in the further motion thereof.

4. The power grinder of claim 3, characterized in that the pincer (34; 334; 1334) is to be opened again by retraction of the active jaw (36; 336; 1336) to its outset position, in which the release position for changing the grinding sheet (16) is reached, and the passive jaw (38; 338; 1338) has reached its end position beforehand, and in the end position of the active jaw (36; 336; 1336), a defined spacing ensues between this active jaw and the passive jaw (38; 338; 1338).

5. The power grinder of claim 4, characterized in that the active jaw (36; 336; 1336), on the other side of the pivot axis (40; 440; 1440), has an extension which acts as a tensing lever (35; 335; 1335), which in a position defined as the tensing position of the second clamping means (34; 334; 1334) can be locked releasably relative to the housing (12).

6. The power grinder of claim 1, characterized in that the grinding sheet (16) can be inserted between the clamping jaws (22; 220; 1220) and the grinding sheet holder (14), and the clamping jaw (22; 220; 1220) can be opened only by contact with the grinding sheet (16), which upon motion counter to the insertion direction can be automatically arrested as a consequence of this motion.

* * * * *